United States Patent [19]

Holcombe et al.

[11] 4,033,718

[45] July 5, 1977

[54] PHOTOACTIVATED BLEACHING PROCESS

[75] Inventors: Thomas Charles Holcombe; Robert Howard Schultz, both of Cincinnati, Ohio

[73] Assignee: The Procter & Gamble Company, Cincinnati, Ohio

[22] Filed: Sept. 8, 1975

[21] Appl. No.: 611,588

Related U.S. Application Data

[62] Division of Ser. No. 419,320, Nov. 27, 1973, abandoned.

[52] U.S. Cl. ..... 8/103; 252/95; 252/99; 252/186; 252/102; 252/103; 8/101; 8/107; 8/111

[51] Int. Cl.[2] ..... D06L 3/02; D06L 3/04

[58] Field of Search ..... 252/94, 95, 99, 102, 252/103, 182; 260/314.5; 8/111, 101, 103, 107

[56] References Cited

FOREIGN PATENTS OR APPLICATIONS

| | | |
|---|---|---|
| 72-3212 | 5/1972 | South Africa |
| 1,372,035 | 10/1974 | United Kingdom |

*Primary Examiner*—Mayer Weinblatt
*Attorney, Agent, or Firm*—David F. Chalmers; William H. Gould; Thomas H. O'Flaherty

[57] ABSTRACT

Detergent compositions containing particular species of sulfonated zinc phthalocyanine were found to be unexpectedly effective bleach photoactivators for removing stains from textiles. These species are principally tri- and tetra-sulfonates, especially the latter, with minor amounts of di-sulfonates permitted.

8 Claims, No Drawings

PHOTOACTIVATED BLEACHING PROCESS

This is a division of application Ser. No. 419,320, filed Nov. 27, 1973 and now abandoned.

BACKGROUND OF THE INVENTION

1. Field of the Invention

South African No. 72-3212, an application for letters patent filed May 10, 1972 by The Procter & Gamble Company which was laid open for public inspection on Feb. 23, 1973 and sealed on June 4, 1973, which is herein incorporated by reference, disclosed a photoactivated bleaching process whereby stains are removed from textiles through the use of detergent solutions containing sulfonated zinc phthalocyanine. These solutions are irradiated with visible light and exposed to oxygen during the washing and bleaching process. A preferred photoactivator was said to be sulfonated zinc phthalocyanine which was free from unsulfonated zinc phthalocyanine. Variation in the degree of sulfonation of zinc phthalocyanine was said not to affect the efficacy of the material as a photoactivator.

The instant invention recognizes the fact that sulfonated zinc phthalocyanine is not a single entity but may be any of four species: mono-, di-, tri-, and tetra-sulfonated zinc phthalocyanine. The characteristics of each species have been determined, and particular mixtures have been found to have unexpectedly beneficial results in the aforesaid photoactivated bleaching process.

2. Prior Art

Zinc phthalocyanine was first prepared by Sir Reginald Linstead and co-workers at the Imperial College of Science and Technology of London in the 1930's, as reported in Barrett, Dent, and Linstead, "Journal of the Chemical Society," (1936) at page 1719. Then, as now, the zinc compound has tended to live in the shadow of its copper analog which is now produced in quantities of millions of pounds per year for use as pigments and dyes. The chemistry of the zinc compound is similar to that of the copper compound in that each can be made by similar processes; each occurs in three crystalline phase structures; and each undergoes similar chemical reactions such as chlorination and sulfonation. However the properties of the analogs are sufficiently distinct that it is mainly the copper compounds that have found commercial utilization.

Unsubstituted metal phthalocyanines are soluble in water to an unusually low degree and are used as pigments. Water solubility can be achieved to a progressively greater degree by introduction of hydrophilic groups such as sulfo, carboxy, or chloromethyl groups into the phthalocyanine molecule. This is most conveniently done by sulfonation, and up to four sulfo groups can be introduced by the use of hot oleum. Sulfonated phthalocyanines are useful as direct dyes because they have an affinity for cellulose in the form of either cotton or paper pulp. Copper is the only metal used commercially in this way, and produces dyes that are blue to yellow-green in color depending on the other substituents in the molecule. A good reference work on phthalocyanine pigments and dyes is "The Chemistry of Synthetic Dyes and Pigments," edited by H. A. Lubs, Reinhold, N.Y. (1955).

SUMMARY OF THE INVENTION

Zinc phthalocyanine can be readily sulfonated by heating with oleum. It has now been found that particular species of sulfonated zinc phthalocyanine are unexpectedly effective bleach photoactivators for removing stains from cotton textiles. This invention embraces these unexpectedly effective species, detergent compositions containing them, and photoactivated bleach processes using them.

Chemical instability of sulfonated zinc phthalocyanine during analytical manipulation has prevented characterization of these effective species in absolute terms. However quantitative thin layer chromatography (TLC), using an integrating densitometer, has enabled characterization of the various species in terms of their relative densitometer values (RDV's), which method is hereinafter described in detail.

Using this method of characterizing the several species of sulfonated zinc phthalocyanine, the relative densitometer values (RDV's) of the various sulfonated species of the invention are:

Unsulfonated: 0
Monosulfonated: 0
Disulfonated: 0 to 15
Tri- plus tetra-: (100)-(RDV for disulfonated).

Preferred bleach photoactivators are sulfonated zinc phthalocyanines having the following RDV's:

Unsulfonated: 0
Monosulfonated: 0
Disulfonated: 0 to 4
Tetrasulfonated: 64 to 94
Trisulfonated: (100)-(RDV for disulfonated)-(RDV for tetrasulfonated).

Highly preferred bleach photoactivators are sulfonated zinc phthalocyanines having RDV's as follows:

Unsulfonated: 0
Monosulfonated: 0
Disulfonated: 0
Tetrasulfonated: 84 to 94
Trisulfonated: (100)-(RDV for tetrasulfonated).

All of the above mixtures of species are economically attractive because they can be made, without purification, by direct sulfonation with 15 to 65% oleum.

DETAILS OF THE INVENTION

Preparation of the Sulfonated Zinc Phthalocyanines of This Invention

Zinc phthalocyanine can be readily sulfonated by heating with oleum. A particular sample, designated example no. 11, was prepared in the following manner:

Three hundred ml. (586 grams) of 30% oleum were placed in a 1000 ml. round-bottom vessel having a diameter of approximately 4 inches. Agitation was provided by a flat-bladed impeller conforming in profile to the rounded shape of the vessel bottom and having a maximum diameter of approximately 3½ inches. Mild agitation was provided by rotating the agitator at 100–150 r.p.m.

One hundred twenty grams of zinc phthalocyanine were slowly added to the vessel during agitation, and the vessel thereafter maintained in an oil bath, with continued agitation, at a temperature of 110° C. for 3½ hours. The reaction mixture was quenched by pouring into 1500 ml. of ice water. After neutralizing to pH 7 with NaOH, the solution was dried and ground, yielding about 900 grams of a mixture containing 77.7% sodium sulfate, and 22.3% organic material which was chiefly the tri- and tetra-sulfonated species of zinc phthalocyanine.

Other samples of sulfonated zinc phthalocyanine were prepared similarly, with modifications of the process conditions as shown in Table I and with batch sizes ranging from 60 to 120 grams of zinc phthalocyanine.

Data for examples no. (1) and (4) show, for two different oleum/zinc phthalocyanine ratios, how the composition of the sulfonated zinc phthalocyanine varied with time.

Table I

Preparation of Sulfonated Zinc Phthalocyanine

| Sample/ Example (No.) | Wt. Ratio* of Reactants | Temp. (° C.) | Agitation | Time (Hours) | Species of Sulfonated Zinc Phthalocyanine: Relative Densitometer Values (RDV) Mono | Di | Tri | Tetra |
|---|---|---|---|---|---|---|---|---|
| 1 | 5.0 | 110 | Yes | 0.5 | 0 | 32 | 46 | 22 |
| | | | | 1.0 | 0 | 17 | 50 | 33 |
| | | | | 1.5 | 0 | 7.0 | 51 | 42 |
| | | | | 2.0 | 0 | 3.7 | 49 | 47 |
| | | | | 2.5 | 0 | 2.2 | 46 | 52 |
| | | | | 3.0 | 0 | 1.0 | 38 | 61 |
| | | | | 3.5 | 0 | 0.3 | 33 | 67 |
| | | | | 4.0 | 0 | 0.1 | 27 | 73 |
| | | | | 4.5 | 0 | 0 | 26 | 74 |
| | | | | 5.0 | 0 | 0 | 25 | 75 |
| 2 | 5.0 | 110 | Yes | 3.5 | 0 | 1.1 | 25 | 74 |
| 3 | 4.0 | 110 | Yes | 3.5 | 0 | 13 | 56 | 31 |
| 4 | 3.0 | 110 | Yes | 1.0 | 12 | 44 | 33 | 11 |
| | | | | 2.0 | 6.7 | 42 | 38 | 13 |
| | | | | 3.0 | 4.7 | 44 | 38 | 13 |
| | | | | 3.5 | 2.6 | 36 | 45 | 16 |
| 6 | 4.9 | 113 | No | 3.0 | 5 | 16 | 36 | 43 |
| 7 | 4.9 | 100 | Yes | 2.5 | 0 | 21 | 51 | 28 |
| 9 | 4.9 | 110 | Yes | 2.0 | 0 | 2 | 44 | 54 |
| 11 | 4.9 | 110 | Yes | 3.5 | 0 | 0 | 31 | 69 |
| 15 | 7.3 | 113 | Yes | 5.0 | 0 | 0 | 4 | 96 |

*30% oleum/zinc phthalocyanine

A comparison of the 3.5 hour data for examples no. (1), (2) and (11) illustrates the reproducibility of the sulfonation. The distribution-broadening effect of omitting agitation is shown by example no. (6). The combined effects of high oleum ratio, high temperature and long time, in driving the reaction toward tetrasulfonate is shown by example no. (15).

Samples 16, 17, and 18 were prepared by fractionation of direct sulfonation products:

The preparation of sample 16 was as follows: 80 gm. of zinc phthalocyanine was sulfonated with 200 ml. of 30% oleum and 35 ml. of liquid $SO_3$ at 65° C. for 24 hours. Sixty grams of this material, unneutralized, were thoroughly mixed in 200 ml. of 10% aqueous NaCl at about 10° C., neutralized with caustic, and centrifuged. The liquid phase, after drying, was designated sample no. 16.

The preparation of sample 17 was as follows: 30 gm. of a neutralized product of direct oleum sulfonation of zinc phthalocyanine were thoroughly mixed in 150 ml. of 10% aqueous NaCl, and the mixture cooled to nearly 0° C., which resulted in crystallization of the more insoluble sulfonates. The liquid phase, after centrifuging and drying, was designated sample no. 17.

The liquid column chromatographic method, described infra in the section on analyses, was used to prepare a sample, designated no. 18, of trisulfonated zinc phthalocyanine that was free from mono-, di-, and tetra-sulfonated species.

As explained more fully infra, these samples, even the one prepared by chromatographic methods, are not necessarily free from sulfonation by-products, and indeed may contain proportionately more by-product than unfractionated products.

Sample 5, unlike all others, was used in the form of a detergent-containing flake produced on a roll mill. It consisted of a mixture of 16 parts directly sulfonated zinc phthalocyanine having a methanol soluble of 19%, 21.3 parts sodium dodecyl benzene sulfonate (branched), 26.5 parts sodium triphosphate, 2.1 parts sodium toluene sulfonate, 6.0 parts silicate solids (2.0 ratio $SiO_2/Na_2O$), 0.6 parts sodium carboxymethyl cellulose, 0.2 parts stilbene brightener, 12.5 parts water, and a balance sodium sulfate.

Analysis of Sulfonated Zinc Phthalocyanine

The organic portion of crude sulfonated zinc phthalocyanine was analytically determined by a "methanol soluble". A 1.0 gram sample was heated to boiling on a steam plate with 200 ml. of anhydrous methanol; cooled; and filtered through a crucible. This procedure was repeated until the blue-green material was visibly removed. The methanol filtrate was evaporated and the percent soluble determined gravimetrically. A gravimetric sodium sulfate determination was occasionally made to confirm the accuracy of the methanol soluble method.

Analyses for the several species of sulfonated zinc phthalocyanine, representing different degrees of sulfonation, have been carried out principally by quantitative thin layer chromatography (TLC):

A TLC chamber was equilibrated with a mixed solvent system containing 25 ml. chloroform, 47 ml. pyridine, and 8 ml. water. The TLC plate used was glass, 20 × 20 cm. in size, coated with a silica gel-kieselguhr mixture. A series of 5 micro-liter spots, each containing about 40 micrograms of sulfonated zinc phthalocyanine in aqueous solution, was placed 25 mm. from the bottom of the plate at intervals of 20 mm. The plate was dried, placed in the TLC chamber while the solvent migrated to within about 25 mm. of the top of the plate, and dried again.

Applying this method to unsulfonated zinc phthalocyanine, a single spot was obtained that migrated to the top of the TLC plate nearly as rapidly as the solvent front. Applying the method to a sample of zinc phthalocyanine sulfonate that had been sulfonated under extreme conditions, such as sample no. 15, the predominant spot migrated hardly at all. This was characterized as tetrasulfonated zinc phthalocyanine. Applying the method to samples of zinc phthalocyanine sulfonate that had been sulfonated under mild conditions led to a series of 5 spots, one of which behaved like the unsulfonated zinc phthalocyanine; one of which behaved like the material characterized above as tetrasulfonated zinc phthalocyanine; and three intermediate spots which were characterized respectively as mono-, di-, and tri-sulfonated phthalocyanine.

Commercial samples of sulfonated copper phthalocyanine were also examined by this method, and found to behave similarly, thus strengthening belief in the characterizations described above.

The TLC plates were photographed under ultraviolet illumination for qualitative reference purposes. They were also analyzed quantitatively by visible densitometry, using a Nester/Faust Uniscan 900. As this instrument scanned across the spots of the TLC plate, an integrating circuit printed out the areas under the reflectance curve seen by the visible light transducer. These integrated values were converted to a standardized basis of 100 units of total measured density, thereby eliminating the effects of sample concentration and the existence of by-products, if any, and putting all samples on the basis of active zinc phthalocyanine sulfonate species only. These integrated values are referred to as "relative densitometer values", or RDV's, on Tables I and III and throughout this specification.

The RDV is a consistent and reproducible method of analysis for the various species of sulfonated zinc phthalocyanine. Standard deviations for the samples appearing in Table III were 1.0 for disulfonate, 3.2 for trisulfonate, and 3.5 for tetrasulfonate. The RDV is thus useful in studying processing conditions, as described on Table I, and for studying performance characteristics, as described in Table III. It is also useful for characterizing the unexpectedly effective bleach photoactivators of this invention.

However the RDV is a relative and not an absolute measure of composition, because the molar absorptivities of the various species are believed to differ.

Various other analytical methods have been applied to sulfonated zinc phthalocyanine. One was liquid column chromatography, using successive elutrations of pyridine/chloroform/water mixtures in a column packed with caustic impregnated alumina.

It was possible to clearly separate a series of fractions, each of which produced a single spot on a TLC plate, and which corresponded respectively to the previously described spots for unsulfonated and mono-, di-, tri-, and tetra-sulfonated zinc phthalocyanine species. However, quantitative absorptivity measurements on the pure fractions of replicate column chromatographic separations did not agree. It is known that sulfonated zinc phthalocyanines are relatively unstable compounds, especially when in solution and when in the presence of light, and it is believed that chemical decomposition took place to varying degrees.

Other analytical methods applied to sulfonated zinc phthalocyanine were ion exchange column chromatography, elemental analysis, mass spectrometry (MS), and infrared spectrometry (IR). Instability of the samples during analytical manipulation again occurred. Nevertheless it is believed that sulfonation by-products were initially present, usually in minor amount. Phthalimide, $C_8H_5O_2N$, was qualitatively identified by MS and IR methods, especially in examples no. (14) and (15) that were sulfonated under severe conditions.

The salting out fractionation methods used to prepare samples 16 and 17, and even the chromatographic fractionation used for sample 18, do not assure that sulfonation by-products are absent, because these by-products may be relatively soluble in the fractionating solvents.

For sample 16, RDV's for the direct sulfonation product were 0, 14, 59, and 27, respectively, for the mono-, di-, tri-, and tetra-sulfonated species of zinc phthalocyanine; after fractionation the corresponding RDV's were 0, 0, 64, and 36. For sample 17, corresponding RDV's were 0, 34, 47, and 19 for the direct sulfonation product and 0, 0, 83, 17 after fractionation.

Characteristics of Individual Species of Sulfonated Zinc Phthalocyanine

The column chromatographic method of separation described supra was employed to obtain small quantities of individual species for examination.

All species, including the unsulfonated, are blue-green in visual appearance.

All absorption spectra are similar, with peak locations at 660–673 nm., 633–645 nm., 600–608 nm., and 340–345 nm. Fluorescence peaks of the sulfonated species are also similar: excitation at 275 nm. causes fluorescence at 415–437 nm., while excitation at 395 nm. causes fluorescence at 440–473 nm.

There are, however, significant differences among the pure species in solubility, effectiveness of bleach photoactivation, and blue-green coloration of fabrics.

EXAMPLE 19

Unsulfonated zinc phthalocyanine is a pigment that is virtually insoluble and not appropriate for use as a bleach photoactivator for stain removal from fabrics.

EXAMPLE 20

Monosulfonated zinc phthalocyanine is also insufficiently soluble for this practical use. While it does perform the photoactivation function to a degree, it suffers the serious and intrinsic disadvantage that wherever a particle contacts the fabric surface it leaves behind a noticeable dark green blotch.

EXAMPLE 21

Disulfonated zinc phthalocyanine bleaches more and stains less than monosulfonated zinc phthalocyanine but produces an overall blue-green coloration on the fabric to an undesirable degree when used alone. However minor amounts of disulfonated zinc phthalocyanine can be tolerated when present in a bleach composition consisting primarily of more highly sulfonated species.

EXAMPLE 22

Trisulfonated zinc phthalocyanine is a preferred bleaching agent. It removes stains well and produces only a slight blue-green coloration on the fabric. Trisulfonated zinc phthalocyanine is particularly desirable when used at elevated temperatures, for example when the washing/bleaching process takes place at 110° to 140° F., because its bleaching effectiveness increases with temperature.

EXAMPLE 23

Tetrasulfonated zinc phthalocyanine is also a preferred bleaching agent. It removes stains well and produces less coloration on the fabric than any of the other species. Its bleaching effectiveness is little affected by temperature.

Bleach Photoactivation Produced in the Laboratory by Sulfonated Zinc Phthalocyanine In the laboratory, bleach photoactivation performance was evaluated by putting uniformly stained swatches under a source of illumination and wetting them repeatedly over a period of time with a detergent solution containing sulfonated zinc phthalocyanine. Following treatment, the swatches were rinsed and dried and their lightness (L) was measured on a Gardner reflectometer and compared with the lightness of the stained swatches before treatment. Details of the test procedure are as follows:

The most commonly used stain was achiote, which was chosen because it is difficult to remove and shows up differences between samples well. Achiote, or achuete, is a yellowish-red dyestuff prepared from the seeds of the annatto tree, *Bixa orellana*, which is native to tropical America. Eight ounces of seeds were boiled in 1½ gallon of city water for 2 hours. The solution was strained three times through a double layer of cheesecloth. Enough water was added to the strained solution to bring its volume back to 1½ gallons, and it was brought to a boil. Twenty-seven square feet of brightener-free cotton muslin were boiled in the solution for 2 hours, following which they were rinsed, passed through a padder wringer, dried in a tumble drier, and aged overnight in the dark at 120° F. Swatches 2½ × 2½ inches in size were cut from the muslin and their lightness (L) was determined by the Gardner reflectometer.

Swatches stained with black tea were prepared by similar methods. This stain was, however, easily removed by sulfonated zinc phthalocyanine. Thus, while tea-stained swatches demonstrate the effectiveness of sulfonated zinc phthalocyanine as a bleach photoactivator, they are not as useful as achiote-stained swatches to show the superiority of certain species over others in the bleach photoactivation process.

Bleach photoactivation of achiote-stained fabrics was accomplished by laying out four 2½ × 2½ in. stained swatches in a transparent flat-bottomed glass dish and illuminating with a 100-watt incandescent light bulb placed 4½ inches above the swatches. Exposure time varied from one to four hours. During this period, each swatch was rewetted every 20 minutes with 2 ml. of a solution at 75° F. containing:

1. hardness — 18 grains per gallon, 3/1 $Ca^{++}/Mg^{++}$
2. detergent — 0.4 or 0.5% of a commercial detergent having the following composition:

| | Wt. % |
|---|---|
| Sodium dodecyl benzene sulfonate (branched) | 26.2 |
| Sodium triphosphate | 32.5 |
| Sodium toluene sulfonate | 2.6 |
| Silicate solids (2.0 ratio $SiO_2/Na_2O$ | 6.0 |
| Sodium sulfate | 16.9 |
| Brightener | 0.2 |
| Perfume | 0.15 |
| Moisture | 14.0 |
| Miscellaneous | 0.9 |

-continued

| | Wt. % |
|---|---|
| | 100.0% |

3. sulfonated zinc phthalocyanine — species and concentration as specified for each particular test.

The procedure used for bleaching the tea-stained fabrics included on Table II was in general similar to that described supra for achiote-stained fabrics; however it differed in that the swatches were first washed in a solution of bleach photoactivator and then rewet with plain water.

Following exposure, the swatches were rinsed, dried, and their lightness measured on the reflectometer. The change from their lightness in the stained condition was calculated as ΔL which was used as a measure of bleach photoactivation.

The percent active for the test samples prepared by direct oleum sulfonation was obtained by the methanol soluble method described supra. For the fractionated samples, it was measured by evaporation to dryness.

The bleach photoactivation (ΔL) for each of 5 different test series (A, B, C, D, and E) is shown on Table II. The preparation of the sulfonated zinc phthalocyanine samples used in examples 6, 7, 9, 11 and 15 was detailed in Table I of the previous section, and the preparation of the other samples was carried out by substantially similar methods, with minor variations in process conditions.

The results of each test series are presented separately because the samples were tested at the same time and the test procedures were, insofar as possible, identical in every respect. For each test series, the bleach photoactivation, ΔL, was plotted against the solution concentrations of sulfonated zinc phthalocyanine, and the samples were ranked for Relative Bleach Photoactivation (RBP) at equal concentrations, using the 4-point scale presented below.

Table II

| Test Series | Sample/ Example (no.) | Active % | Solution Conc. (ppm) | Bleach Photoactivation (ΔL) Achiote | Tea | Coloration Bluing (Δa) | Greening (Δb) |
|---|---|---|---|---|---|---|---|
| A | 5 | 3.1 | 4.0 | 6.5 | 11.3 | 0.3 | 2.0 |
| | | | 12.0 | 8.4 | 12.4 | 1.0 | 4.5 |
| | 6 | 21.3 | 4.3 | 5.7 | 11.4 | 0.1 | 1.3 |
| | | | 12.8 | 7.8 | 12.3 | 0.6 | 3.2 |
| | 7 | 20.0 | 4.0 | 7.0 | 12.0 | 0.6 | 3.3 |
| | | | 12.0 | 7.9 | 12.5 | 1.6 | 6.3 |
| | 9 | 20.8 | 4.2 | 6.7 | 11.8 | 0.4 | 2.0 |
| | | | 12.5 | 9.2 | 12.1 | 1.0 | 4.3 |
| | 11 | 22.3 | 4.5 | 7.4 | 11.8 | 0.2 | 1.7 |
| | | | 13.4 | 8.8 | 12.2 | 0.8 | 3.7 |
| | 15 | 16.9 | 3.4 | 3.7 | 10.3 | 0.1 | 0.5 |
| | | | 10.1 | 6.5 | 11.1 | 0.1 | 1.1 |
| B | 11 | 22.3 | 2.2 | 3.5 | | 0.4 | 2.1 |
| | | | 4.5 | 4.7 | | 0.7 | 3.2 |
| | | | 6.7 | 5.4 | | 1.0 | 4.1 |
| | 14 | 23.5 | 4.0 | 4.3 | | 0.4 | 2.7 |
| | | | 8.0 | 6.0 | | 0.8 | 3.6 |
| | | | 16.0 | 6.8 | | 1.4 | 5.4 |
| | 15 | 16.9 | 5.2 | 3.2 | | 0 | 1.4 |
| | | | 10.4 | 4.2 | | 0.1 | 2.4 |
| | | | 20.8 | 5.5 | | 0.3 | 3.6 |
| C | 11 | 22.3 | 2.2 | 4.1 | | 0.2 | 2.2 |
| | | | 4.5 | 4.2 | | 0.5 | 3.6 |
| | | | 6.7 | 5.2 | | 0.9 | 4.6 |
| | 15 | 16.9 | 5.2 | 3.3 | | 0.3 | 1.5 |
| | | | 10.4 | 3.4 | | 0.2 | 2.4 |
| | | | 20.8 | 4.9 | | 0.1 | 3.9 |
| | 18 | 0.0137 | 1.0 | 4.0 | | 1.1 | 4.6 |
| | | | 2.0 | 4.4 | | 1.9 | 6.3 |
| | | | 3.0 | 4.9 | | 2.4 | 7.3 |

Table II-continued

| Test Series | Sample/ Example (no.) | Active % | Solution Conc. (ppm) | Bleach Photoactivation (ΔL) Achiote Tea | (Δb) | Coloration Blueing (Δa) | Greening |
|---|---|---|---|---|---|---|---|
| D | 8 | 12.9 | 1.8 | 4.1 | | 1.6 | 5.7 |
| | | | 5.5 | 6.0 | | 3.5 | 10.2 |
| | | | 9.2 | 7.3 | | 4.6 | 12.5 |
| | 10 | 23.3 | 2.3 | 2.8 | | 0.7 | 3.4 |
| | | | 7.0 | 6.3 | | 2.0 | 7.2 |
| | | | 11.7 | 6.6 | | 2.6 | 9.0 |
| | 11 | 22.3 | 2.5 | 3.6 | | 0.8 | 3.8 |
| | | | 7.4 | 7.1 | | 1.9 | 7.1 |
| | | | 12.4 | 6.9 | | 2.6 | 9.2 |
| E | 9 | 20.8 | 1.0 | 3.0 | | 0.7 | 3.6 |
| | | | 10.4 | 7.1 | | 2.3 | 11.6 |
| | 11 | 22.3 | 1.1 | 2.8 | | 0.5 | 2.7 |
| | | | 11.2 | 6.7 | | 2.1 | 9.6 |
| | 12 | 23.5 | 1.2 | 2.9 | | 0.6 | 2.8 |
| | | | 11.8 | 7.4 | | 1.6 | 9.7 |
| | 13 | 19.6 | 1.1 | 2.9 | | 0.5 | 2.4 |
| | | | 10.9 | 6.9 | | 1.1 | 8.3 |
| | 16 | 4.0 | 1.0 | 2.1 | | 0.6 | 2.7 |
| | | | 10.0 | 6.2 | | 1.4 | 9.3 |
| | 17 | 1.0 | 1.0 | 1.5 | | 0.3 | 1.9 |
| | | | 10.0 | 4.9 | | 0.4 | 7.3 |

This ranking was facilitated by the fact that one sample, no. 11, was present in each of the five test series.

| Rank | Description |
|---|---|
| 4 | Excellent |
| 3 | Good (sample no. 11) |
| 2 | Fair |
| 1 | Poor |

These RBP values are presented in Table III. Most samples are ranked good or excellent and contain primarily tri- and tetra-sulfonated zinc phthalocyanine. The exceptions are principally:

1. Samples 5, 6 and 7 contain at least 21% of sulfonated species lower than tri-; i.e., mono- plus di-. All other samples contain 6% or less of these species.
2. Sample 15 is consistently poor. It is believed that the extreme conditions of sulfonation for the sample, as shown on Table I and as discussed in the previous section on preparation, resulted in the presence of higher than usual amounts of by-products, as discussed in the previous section on analysis. Indeed, visual examination suggested that about half of the organic portion of this sample might be species other than the blue-green sulfonated zinc phthalocyanines. It must be remembered that the RBP values are not absolute measurements, but a relative, though quantitative, breakdown of the sulfonated zinc phthalocyanine species that are present in the mono-, di-, tri-, and tetra-fractions.
3. Samples 16 and 17 were prepared by fractional crystallization techniques as detailed supra. It is believed that these samples, too, contain larger than normal amounts of by-products which are ineffective as bleach photoactivators.

Table III

Bleach Photoactivation and Blue-Green Coloration Produced by Sulfonated Zinc Phthalocyanine

| Sample/Example No. | 5 | 6 | 7 | 8 | 9 | 10 | 11 | 12 | 13 | 14 | 15 | 16 | 17 | 18 |
|---|---|---|---|---|---|---|---|---|---|---|---|---|---|---|
| Method of Synthesis | ———direct sulfonation products——— | | | | | | | | | | | fractionated | | |
| Relative Densitometer Values (RDV) | | | | | | | | | | | | | | |
| Mono | 11 | 5 | 0 | 0 | 0 | 0 | 0 | 0 | 0 | 0 | 0 | 0 | 0 | 0 |
| Di | 17 | 16 | 21 | 6 | 2 | 0 | 0 | 2 | 0 | 0 | 0 | 0 | 0 | 0 |
| Tri | 37 | 36 | 51 | 64 | 44 | 39 | 31 | 15 | 14 | 9 | 4 | 64 | 83 | 100 |
| Tetra | 35 | 43 | 28 | 30 | 54 | 61 | 69 | 83 | 86 | 91 | 96 | 36 | 17 | 0 |
| Relative Bleach Photoactivaton (RBP) - achiote | | | | | | | | | | | | | | |
| Test Series A | 2 | 1 | 2 | | 3 | | 3 | | | | 1 | | | |
| Test Series B | | | | | | | 3 | | | 3 | 1 | | | |
| Test Series C | | | | | | | 3 | | | | 1 | | | 4 |
| Test Series D | | | | 4 | | 2 | 3 | | | | | | | |
| Test Series E | | | | | 4 | | 3 | 3 | 4 | | | 2 | 1 | |
| Relative Blue-Green Coloration (RBG) | | | | | | | | | | | | | | |
| Test Series A | 2 | 2 | 1 | | 2 | | 3 | | | | 3 | | | |
| Test Series B | | | | | | | 3 | | | 4 | 4 | | | |
| Test Series C | | | | | | | 3 | | | | 4 | | | 1 |
| Test Series D | | | | 1 | | 2 | 3 | | | | | | | |
| Test Series E | | | | | 2 | | 3 | 3 | 4 | | | 2 | 2 | |

Blue-Green Coloration Produced in the Laboratory by Sulfonated Zinc Phthalocyanine When exposed to light, sulfonated zinc phthalocyanine is capable of bleach photoactivation, and in the process thereof is itself destroyed and decolorized. When, however, a washing operation takes place in the absence of light, the sulfonated zinc phthalocyanine that absorbs on a fabric acts as a dye and colors it weakly blue-green. Although subsequent exposure of the fabric to light causes this color to disappear, the phenomenon is thought to be undesirable. Accordingly, each sample of Test Series A, B, C, D, and E was examined for blue-green coloration in the dark as well as for bleach photoactivation in the light. Laboratory procedure was as follows:

Brightener-free cotton muslin 2½ × 2½ in. swatches were soaked in the dark for 18 hours at 75° F., using 100 gm. water per gm. of cloth. Alternatively, the swatches were washed for 5 minutes at 75° F., using 200 gm. water per gm. of cloth. In each case the solutions were, for each sample, the same as those used for photobleaching. Following rinsing and drying, values of (−b) blueness and (−a) greenness were measured on a Gardner reflectometer.

The changes from $a$ and $b$ values of the swatches before testing are given on Table II as $\Delta a$ and $\Delta b$, respectively. These values were combined into a blue-green coloration $\Delta a,b$ by the relationship $$\Delta a,b = [(\Delta a)^2 + (\Delta b)^2]^{1/2}.$$

The $\Delta a,b$ values were then plotted against ΔL values for the same samples to determine the relative blue-green coloration (RBG) at concentrations producing equal bleach photoactivation. It is emphasized that the blue-green coloration effect of various samples was not evaluated at equal concentration, but at equal bleach photoactivation.

Rank values of RBG appearing on Table III were obtained in a manner analogous to that described supra for bleach photoactivation. By this means of manipulating the data the effects by varying amounts of inert by-products are eliminated. It can be readily seen that RDV's for the tetrasulfonated zinc phthalocyanine species are the criteria for distinguishing the blue-green coloration produced by these samples:

| RDV for Tetrasulfonated Zinc Phthalocyanine | | | |
|---|---|---|---|
| RBG Rank | Average | Range | No. of Samples |
| 4 | 92 | [86–96 | 4] |
| 3 | 75 | [69–96 | 7] |
| 2 | 43 | [11–61 | 7] |
| 1 | 19 | [ 0–30 | 3] |

Bleach Photoactivation Produced by Sulfonated Zinc Phthalocyanine Using Natural Illumination Stained cotton muslin swatches were washed in detergent compositions in a laboratory tergitometer and exposed to the sun for bleaching. Bleach photoactivator compositions corresponded to those of samples no. 5, 6, and especially 11.

In one series of tests, washed swatches were laid out flat on the ground for 30 minutes. On 10 of 11 stains, including such common stains as coffee, grape and mustard, the stained fabrics washed in a detergent solution which contained sulfonated zinc phthalocyanine were bleached to a lighter color than the control samples washed in a detergent composition that was identical except for the absence of the bleach photoactivator.

Other bleaching tests, using sulfonated zinc phthalocyanine sample no. 11 at levels of 1–10 ppm. in the wash solution, exposed previously stained and washed cotton fabrics to the sun in a sun-bleaching process involving laying them flat, without rinsing, and rewetting them every 20–30 minutes over a 1–4 hour period. When rewet with water, bleaching occurred, as the fabrics which had been washed in a solution containing sulfonated zinc phthalocyanine were lighter in color than control fabrics which had been washed in a comparable solution except for the absence of photoactivator. When the fabrics were rewet, not with water but with additional washing solution containing sulfonated zinc phthalocyanine, still greater bleaching occurred. Stains which were effectively bleached in these tests included: achiote, banana sap, catsup, coconut, coffee, duhat, grass, ink, mango, mustard, papaya, soy sauce, spinach and tea.

In still another test, naturally soiled aprons and kitchen rags were effectively bleached when handwashed in detergent compositions containing sulfonated zinc phthalocyanine sulfonate and sunbleached by the rewetting method described above.

The essential elements of the washing and bleaching solutions of this invention are organic surfactant, alkaline builder salt, and from 0.025 to 1.25% sulfonated zinc phthalocyanine by weight of the composition, where the sulfonated zinc phthalocyanine is characterized as herein described. Preferred usage of sulfonated zinc phthalocyanine is from 0.05 to 0.5%. Other adjuvants can optionally be present, such as soil suspending agents, suds control agents, optical brightening agents, colorants, perfumes, and other agents well known to those skilled in the detergent and bleaching arts.

The organic surfactant can be any anionic, soap or non-soap. The alkaline builder salt can be inorganic, such as a salt of triphosphate, pyrophosphate, carbonate, and the like; or can be organic, such as a salt of nitrilotriacetic acid, citric acid, mellitic acid, and the like.

The concentration of bleach photoactivator in the washing and bleaching solutions can be from 0.25 to 125 parts per million, preferably 1 to 20 ppm. The washing process can be carried out at any temperature commonly used in the home; i.e., 60°–140° F., preferably 80°–110° F. The bleaching process during exposure to light can be carried out at whatever temperature is ambient, or it can be at an elevated temperature, for example, if heated by the source of artificial illumination.

An alternative bleaching process is to combine it with the washing process by strongly irradiating the washing solution with visible light, as described in a patent application filed by Speakman on June 26, 1973 as U.S. Ser. No. 373,697. The species of sulfonated zinc phthalocyanine of this invention, especially sample 11, were shown to be particularly effective bleach photoactivators when used in this way.

The Sulfonated Zinc Phthalocyanine Species of This Invention

The prior art has taught that sulfonation of zinc phthalocyanine with oleum produces a bleach photoactivator. Examination of the various pure species of sulfonated zinc phthalocyanine has now shown that the trisulfonated and tetrasulfonated species are each particularly good photoactivators, while the monosulfonated and disulfonated species are not.

The data of Table III show that samples 5, 6, and 7 are relatively poor in both the RBP and RBG tests.

Each of these samples has an RDV of 21 or more for combined mono- and di-sulfonated species of sulfonated zinc phthalocyanine, while each of the other samples has an RDV of 0 for the monsulfonated species and an RDV of 6 or less for the disulfonated. It is concluded that a maximum RDV of 15 for disulfonated zinc phthalocyanine can be tolerated when the remainder of the species are tri- and tetra-sulfonated; i.e., their combined RDV is 100 minus the RDV for the disulfonated species.

Preferred bleach photoactivator samples of Table III are samples 11, 12, 13, and 14 which are consistently ranked good or excellent by both the RBP and RBG criteria. These preferred embodiments have RDV's of 0 for unsulfonated and monosulfonated zinc phthalocyanine sulfonate, 0 or 2 for disulfonated, and 69, 83, 86, and 91, respectively, for tetrasulfonated. All other samples have RDV's of 54 or below or 96. It has been explained supra that relatively high tetrasulfonated is desirable to minimize RBG, while an RDV value as high as 96 is indicative of severe sulfonation conditions and abnormally large amounts of by-products. Accordingly the preferred species can be characterized as having RDV's of zero for unsulfonated and monosulfonated species of zinc phthalocyanine; an RDV of 0 to 4 for disulfonated; an RDV of 64 to 94 for tetrasulfonated; with the balance trisulfonated, i.e. an RDV of (100) minus the combined RDV's for the di-plus tetrasulfonated species.

Highly preferred compositions are those represented by samples 13 and 14. These are characterized by RDV's of zero for the unsulfonated and mono- and di-sulfonated species of zinc phthalocyanine; an RDV of 84 to 94 for tetrasulfonated; and the balance trisulfonated, i.e. an RDV of (100) minus the RDV for tetrasulfonated.

All of the above mixtures of species are economically attractive because they can be made, without purification, by direct sulfonation with 15 to 65% oleum. Sulfuric acid is not strong enough to sulfonate satisfactorily, while the relatively low solubility of the reactant zinc phthalocyanine in pure $SO_3$ requires an excessive use of the powerful sulfonating agent and results in oversulfonation. Hence a range of oleums of intermediate strength are suitable sulfonating agents.

The washing, sunbleaching and rewetting processes described supra are common practices among peoples who do not have access to washing machines and gas or electric dryers, especially in tropical countries where the sun is bright. Drying fabrics suspended on a clothesline is also an effective way to utilize the bleach photoactivation of this invention.

What is claimed is:

1. A process for removing stains from textiles which comprises treating the textiles, in the presence of visible light and oxygen, with an aqueous solution containing:

a. a concentration of from 78 milligrams per liter to 1,440 milligrams per liter of an anionic surfactant;

b. a concentration of from 215 milligrams per liter to 2,140 milligrams per liter of an alkaline builder salt; and c. a concentration of from 0.25 milligrams per liter to 125 milligrams per liter of a bleach photoactivator which is a mixture of sulfonated zinc phthalocyanine species in which the relative densitometer values (RDV's) of the various sulfonated zinc phthalocyanine species in the mixture are:

| Specie | RDV |
|---|---|
| unsulfonated | 0 |
| monosulfonated | 0 |
| disulfonated | 0–15 |
| trisulfonated plus tetrasulfonated | (100)-(RDV for disulfonated). |

2. The process of claim 1 in which the concentration of the mixture of sulfonated zinc phthalocyanine species is from 1 milligram per liter to 20 milligrams per liter.

3. The process of claim 1 in which the RDV's of the sulfonated zinc phthalocyanine species in the mixture of sulfonated zinc phthalocyanine species used therein are:

| Specie | RDV |
|---|---|
| unsulfonated | : 0 |
| monosulfonated | : 0 |
| disulfonated | : 0–4 |
| tetrasulfonated | : 64–94 |
| trisulfonated | : (100)-(RDV for disulfonated)-(RDV for tetrasulfonated). |

4. The process of claim 1 in which the RDV's of the sulfonated zinc phthalocyanine species in the mixture of sulfonated zinc phthalocyanine species used therein are:

| Specie | RDV |
|---|---|
| unsulfonated | : 0 |
| monosulfonated | : 0 |
| disulfonated | : 0 |
| tetrasulfonated | : 84–94 |
| trisulfonated | : (100)-(RDV for tetrasulfonated) |

5. The process of claim 1 in which the mixture of sulfonated zinc phthalocyanine species used therein is prepared by direct sulfonation of zinc phthalocyanine with oleum.

6. The process of claim 3 in which the concentration of the mixture of sulfonated zinc phthalocyanine species is from 1 milligram per liter to 20 milligrams per liter.

7. The process of claim 4 in which the concentration of the mixture of sulfonated zinc phthalocyanine species is from 1 milligram per liter to 20 milligrams per liter.

8. The process of claim 5 in which the concentration of the mixture of sulfonated zinc phthalocyanine species is from 1 milligram per liter to 20 milligrams per liter.

* * * * *